US011439178B2

(12) United States Patent
Liu et al.

(10) Patent No.: US 11,439,178 B2
(45) Date of Patent: Sep. 13, 2022

(54) SMOKELESS CIGARETTE HAVING DECREASED VAPOR TEMPERATURE AND PREVENTING HEAT-CAUSED COLLAPSE OF CIGARETTE HOLDER

(71) Applicant: HUBEI CHINA TOBACCO INDUSTRY CO., LTD., Hubei (CN)

(72) Inventors: Huachen Liu, Hubei (CN); Yikun Chen, Hubei (CN); Weichang Ke, Hubei (CN); Chenghao Luo, Hubei (CN); Bing Liu, Hubei (CN)

(73) Assignee: HUBEI CHINA TOBACCO INDUSTRY CO., LTD.

( * ) Notice: Subject to any disclaimer, the term of this patent is extended or adjusted under 35 U.S.C. 154(b) by 291 days.

(21) Appl. No.: 16/616,652

(22) PCT Filed: May 25, 2018

(86) PCT No.: PCT/CN2018/088370
§ 371 (c)(1),
(2) Date: Nov. 25, 2019

(87) PCT Pub. No.: WO2018/214953
PCT Pub. Date: Nov. 29, 2018

(65) Prior Publication Data

US 2020/0205467 A1 Jul. 2, 2020

(30) Foreign Application Priority Data

May 26, 2017 (CN) ..... 201710381745.0

(51) Int. Cl.
*A24D 3/17* (2020.01)
*A24D 1/20* (2020.01)
(Continued)

(52) U.S. Cl.
CPC ..... *A24D 3/17* (2020.01); *A24D 1/002* (2013.01); *A24D 1/20* (2020.01); *A24D 3/04* (2013.01); *A24D 3/061* (2013.01); *A24D 3/067* (2013.01)

(58) Field of Classification Search
CPC . A24D 3/17; A24D 1/002; A24D 1/20; A24D 3/04; A24D 3/061; A24D 3/067;
(Continued)

(56) References Cited

U.S. PATENT DOCUMENTS 5,067,499 A * 11/1991 Banerjee ..... A24D 1/22 131/194
2007/0240729 A1 10/2007 Moffitt
(Continued)

FOREIGN PATENT DOCUMENTS

CN 102821632 12/2012
CN 204157643 2/2015
(Continued)

OTHER PUBLICATIONS

International Search Report for PCT/CN2018/088370 dated Jul. 30, 2018, 4 pages.
(Continued)

*Primary Examiner* — Timothy Kennedy
*Assistant Examiner* — Guy F Mongelli
(74) *Attorney, Agent, or Firm* — Fresh IP PLC; Clifford D. Hyra; Aubrey Y. Chen

(57) ABSTRACT

A smokeless cigarette having a decreased vapor temperature and preventing the heat-caused collapse of a cigarette holder comprises a filter tip, a heat-resistant hollow section and a tobacco section sequentially connected, wherein the heat-resistant hollow section consists of a heat-resistant hollow section cover and a heat-resistant hollow section hollow layer. The heat-resistant hollow section is made by rolling a
(Continued)

high-temperature resistant material into a hollow tubular structure; the high-temperature resistant material forms the heat-resistant hollow section cover. The heat-resistant hollow section hollow layer is a cavity structure formed and surrounded by the heat-resistant hollow section cover. An inner layer of the heat-resistant hollow section cover is coated with a layer of phase-change heat-absorbing material, or the heat-resistant hollow section hollow layer is filled with a phase-change heat-absorbing material.

12 Claims, 2 Drawing Sheets

(51) Int. Cl.
*A24D 1/00* (2020.01)
*A24D 3/06* (2006.01)
*A24D 3/04* (2006.01)

(58) Field of Classification Search
CPC ..... A24D 1/045; A24D 3/062; A24D 1/00; A24D 1/042; A24D 1/04; A24B 15/167; A24B 15/283
See application file for complete search history.

(56) References Cited

U.S. PATENT DOCUMENTS

2015/0209530 A1* 7/2015 White ..... A61M 11/048 424/729
2016/0150825 A1* 6/2016 Mironov ..... A24D 1/20 219/634

FOREIGN PATENT DOCUMENTS

| | | | | |
|---|---|---|---|---|
| CN | 204707983 | | 10/2015 | |
| CN | 105054281 | A * | 11/2015 | ..... A24D 1/002 |
| CN | 205512325 | | 8/2016 | |
| CN | 107087811 | | 8/2017 | |
| CN | 207040862 | | 2/2018 | |
| JP | 2009-148233 | | 7/2009 | |
| WO | 2007/093852 | | 8/2007 | |

OTHER PUBLICATIONS

Written Opinion of the ISA for PCT/CN2018/088370 dated Jul. 30, 2018, 4 pages.

* cited by examiner

SMOKELESS CIGARETTE HAVING DECREASED VAPOR TEMPERATURE AND PREVENTING HEAT-CAUSED COLLAPSE OF CIGARETTE HOLDER

This application is the U.S. national phase of International Application No. PCT/CN2018/088370 filed May 25, 2018 which designated the U.S. and claims priority to CN Patent Application No. 201710381745.0 filed May 26, 2017, the entire contents of each of which are hereby incorporated by reference.

FIELD OF THE INVENTION

The present invention relates to the field of novel cigarette technologies, and in particular, to a low temperature cigarette having a decreased vapor temperature and preventing the heat-caused collapse of a cigarette holder.

BACKGROUND OF THE INVENTION

For a low temperature cigarette, the tobacco is heated by an outer heating element, and tobacco smoke is generated by heating, rather than burning, the atomizing medium in the tobacco rod, the flavor component in the tobacco and an added flavor, thus the known-type noxious smoke dust components generated by the burning and thermal degradation of the tobacco in the traditional cigarette may be reduced. In the outer source-heated novel cigarette, an important component part is a tobacco rod of the heated cigarette, which is a tobacco product that can release vapor aerosol in a low-temperature heating condition. This tobacco product generally can reach the atomization temperature in a condition of 200° C.-400° C., and the temperature of the high-temperature atomized vapor entering the mouth through the filter tip section is higher than the temperature of that of an ordinary burning cigarette.

Chinese patent application No. CN201610246284.1 discloses a tobacco rod that can lower the vapor temperature by reflowing the vapor in the tobacco rod, but such a tobacco rod structure is not applicable for peripheral heating. In peripheral heating, due to the vapor throttling of the tobacco, the length of the tobacco shreds in the tobacco rod is basically consistent with the heated region, thus heat-caused collapse tends to occur to the cigarette holder near the tobacco shreds end during heating, thereby causing the deformation of the cigarette holder and the difficulty in lowering the temperature of the tobacco rod.

SUMMARY OF THE INVENTION

To overcome the disadvantage of the prior art, the prevent invention provides a low temperature cigarette tobacco rod having a decreased vapor temperature and preventing the heat-caused collapse of the cigarette holder.

A low temperature cigarette having a decreased vapor temperature and preventing the heat-caused collapse of a cigarette holder, comprises: a filter tip, a heat-resistant hollow section and a tobacco section sequentially connected, where the heat-resistant hollow section is constructed by a heat-resistant hollow section housing and a hollow layer for heat-resistant hollow section, and the heat-resistant hollow section is made by rolling a high temperature-resistant material into a hollow tubular structure, where the heat-resistant hollow section housing is formed by the high temperature-resistant material, the hollow layer for heat-resistant hollow section is a cavity structure surrounded by the heat-resistant hollow section housing, and an inner layer of the heat-resistant hollow section housing is coated with a layer of phase-change heat-absorbing material or the hollow layer for heat-resistant hollow section is filled with a phase-change heat-absorbing material.

Further, the tobacco section consists of the following components by mass percent: tobacco shreds 5%-77%, tobacco slices 20%-92%, an atomizing agent 2%-40%, supplementary materials 0-10%, a tobacco extract 0.1%-20%, tobacco flavors and essences 0.01%-6% and a heat-sensitive capsule 0-5%, where the heat-sensitive capsule is filled with flavoring water or water, which is released when the heat-sensitive capsule is heated to a temperature higher than 210° C., and the vapor temperature of the cigarette is lowered via the heat absorption by the water or the flavoring water.

Further, the filter tip section is added with a fragile flavoring capsule.

Further, the hollow layer for heat-resistant hollow section has a loose porous structure or a hollow structure, where the ventilation direction of the loose porous structure is consistent with a circulation direction of the vapor in the cigarette.

Further, the hollow structure has a circle, square, rectangle or triangle sectional shape.

Further, the phase-change heat-absorbing material comprises one of a hydroxy acrylic resin and a polylactic acid, or a mixture thereof.

Further, the high temperature-resistant material is a high temperature-resistant fibrous material, ceramic material, non-woven fabric or paper.

Further, the heat-resistant hollow section housing has a wall thickness of 0.5-1.1 mm.

Further, the filter tip is provided with a hollow section near or far from the heat-resistant hollow section.

Further, the heat-resistant hollow section housing is formed with a vent hole in communication with the hollow layer for heat-resistant hollow section.

A low temperature cigarette having a decreased vapor temperature and preventing the heat-caused collapse of a cigarette holder, comprises a filter tip, a tobacco section and a heat-resistant hollow section provided between the filter tip and tobacco section, where the heat-resistant hollow section is constructed by a heat-resistant hollow section housing and a hollow layer for heat-resistant hollow section, and the heat-resistant hollow section is a hollow tubular structure formed by a high temperature-resistant material, where the heat-resistant hollow section housing is formed by the high-temperature resistant material, the hollow layer for heat-resistant hollow section is a cavity structure surrounded by the heat-resistant hollow section housing, and an inner layer of the heat-resistant hollow section housing is coated with a heat-absorbing material or the hollow layer for heat-resistant hollow section is filled with a heat-absorbing material.

Further, the heat-absorbing material comprises one of hydroxy acrylic resin, polylactic acid, polyethylene, polymethyl methacrylate, polyethylene terephthalate, polypropylene, polyvinyl chloride, ceramic and metal, or a mixture thereof.

Further, a hollow section, which is surrounded by a housing having no heat absorption nature, is provided between the heat-resistant hollow section and the tobacco section.

Further, the outer wall of the filter tip section is radially provided with a vent hole.

The present invention has the following beneficial effects: (1) the heat-resistant hollow section designed in the tobacco rod section can both be applicable to an inner core heater and better fit with a peripheral heater, and avoid the heat-caused collapse of a cigarette holder that would be otherwise contacting with tobacco shreds due to heat transferred through the housing; (2) the holes designed in the hollow section can dilute the heat flow in the tobacco rod and lower the vapor temperature by use of the outer cold air; and (3) the introduction of the flavor-enhancing material into the cigarette holder can improve the vapor suction comfortability by use of the lowered vapor temperature.

Figure 1:
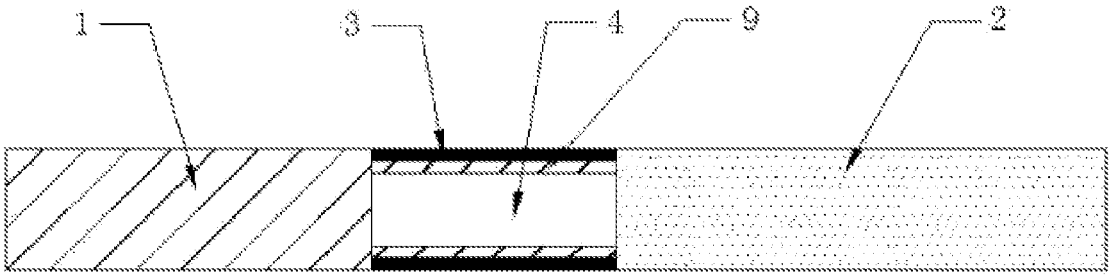
FIG. 1 is a structural representation of Embodiment 1 of the low temperature cigarette having a decreased vapor temperature and preventing the heat-caused collapse of a cigarette holder according to the invention.
Figure 2:
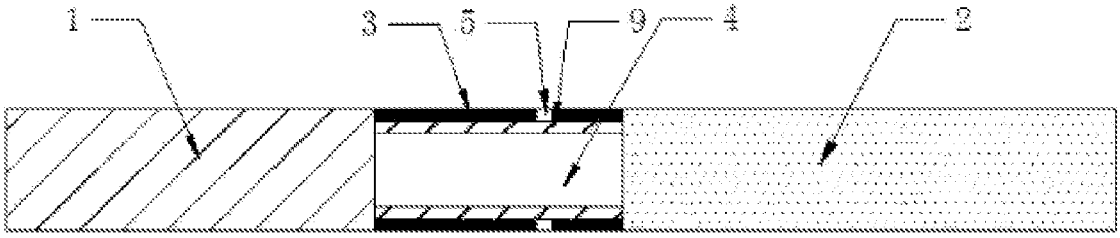
FIG. 2 is a structural representation of Embodiment 2 of the low temperature cigarette having a decreased vapor temperature and preventing the heat-caused collapse of a cigarette holder according to the invention.

In the drawings: 1—Filter Tip Section, 2—Tobacco Section, 3—Heat-Resistant Hollow Section Housing, 4—Hollow Layer for Heat-Resistant Hollow Section, 5—Vent Hole, 6—Hollow Filter Tip Housing, 7—Solid Filter Tip Hollow Layer, 8—Fragile Flavoring Capsule, 9—Heat-Absorbing Layer

DETAILED DESCRIPTION OF THE EMBODIMENTS

The technical solutions in the invention will be described clearly and fully below in conjunction with the drawings in the invention.

Embodiment 1

A low temperature cigarette having a decreased vapor temperature and preventing the heat-caused collapse of a cigarette holder comprises a filter tip 1, a heat-resistant hollow section and a tobacco section 2 sequentially connected, where the heat-resistant hollow section is constructed by a heat-resistant hollow section housing 3, a heat-absorbing layer 9 and a hollow layer for heat-resistant hollow section 4, the hollow layer for heat-resistant hollow section 4 is a hollow structure, and an inner layer of the heat-resistant hollow section housing 3 may be coated with a heat-absorbing layer 9 of a phase-change heat-absorbing material (for example, polylactic acid), or the hollow layer for heat-resistant hollow section 4 may be filled with the phase-change heat-absorbing material. The heat-resistant hollow section housing 3 of the heat-resistant hollow section may be made of a high temperature-resistant material, for example, a high temperature-resistant fibrous material, ceramic material, non-woven fabric or paper, where the fibrous material may be various fibrous materials that can resist a certain high temperature, such as natural fiber, artificial fiber, etc. The hollow layer for heat-resistant hollow section has a loose porous structure or a hollow structure, where preferably the ventilation direction of the loose porous structure is consistent with a circulation direction of the vapor in the cigarette, without changing the airflow direction of the vapor and affecting the suction resistance of the tobacco rod. In this embodiment, the heat-resistant hollow section housing 3 is made by rolling a hollow paper into a hollow tubular structure, and the wall thickness of the hollow paper rod (i.e., the thickness of the heat-resistant hollow section housing 3) is 0.6 mm.

When such a tobacco rod is consumed via peripheral heating, the hot air flow in the heated tobacco section 2 flows into the hollow layer for heat-resistant hollow section 4 along the tobacco rod direction and is mixed with the cold air in the hollow layer for heat-resistant hollow section 4. Further, the inner layer of the heat-resistant hollow section housing 3 is coated with a heat-absorbing layer 9 of a phase-change heat-absorbing material, and the phase-change material absorbs the heat in the hot air flow via phase change, thereby lowering the vapor temperature. After passing through the tobacco section 2, the heat of the tobacco rod transferred from the cigarette paper housing is blocked by the heat-resistant hollow section, thus the heat can be prevented from directly reaching the filter tip 1, the heated temperature of the filter tip 1 can be lowered, and heat-caused collapse of the filter tip material and high vapor temperature can be prevented.

By the novel cigarette prepared in this example, the cigarette vapor temperature may be apparently lowered, and in comparison with the prior-art tobacco rod, under the same condition, the vapor temperature may be lowered by 14-18° C. Further, the collapse caused by the direct contact between the filter tip and the tobacco section may be prevented effectively.

Embodiment 2

A low temperature cigarette having a decreased vapor temperature and preventing the heat-caused collapse of a cigarette holder comprises a filter tip 1, a heat-resistant hollow section and a tobacco section 2 sequentially connected. The difference from Embodiment 1 lies in that: a perforation treatment is performed at a certain position on the heat-resistant hollow section housing 3, thereby forming a vent hole 5 in communication with the hollow layer for heat-resistant hollow section 4. When such a tobacco rod is consumed via peripheral heating, the hot air flow in the heated tobacco section 2 flows into the hollow layer for heat-resistant hollow section 4 along the tobacco rod direction and is mixed with the cold air in the hollow layer for heat-resistant hollow section 4, the outer cold air entering from the vent hole 5 is mixed together with the hot air flow in the tobacco section 2. Further, an inner layer of the heat-resistant hollow section housing 3 is coated with a heat-absorbing layer 9 of a phase-change heat-absorbing material (for example, polycarbonate), and the phase-change material absorbs the heat in the hot air flow via phase change, thus the vapor temperature may be further lowered. The cigarette holder structure of the tobacco rod is marked as A.

In this example, the tobacco section 2 contains tobacco shreds, tobacco slices, an atomizing agent, a tobacco extract, tobacco flavors and essences, etc., where, with respect to the total weight of the tobacco section 2, the tobacco shreds occupy 24% of the total weight, the tobacco slices occupy 57% of the total weight, the atomizing agent which consists of glycerol and ethylene glycol in a mass ratio of 4:1 occupies 15% of the total weight, the tobacco extract occupies 2.5% of the total weight, and the tobacco flavors and essences occupy 0.5% of the total weight. Further, a water-containing heat-sensitive capsule occupying 1% of the total weight may be added, resulting in a formulation B of the tobacco section 2. During heating of the tobacco section, when the temperature exceeds 220° C., the water in the heat-sensitive capsule can be released, and the volatilization of water lowers the temperature of the tobacco section, so that the temperature of the vapor entering the hollow layer for heat-resistant hollow section 4 is overall lowered, which is convenient for the subsequent cooling.

By the structure of the novel cigarette prepared in this example, the cigarette vapor temperature may be apparently lowered, and in comparison with the prior-art tobacco rod, under the same condition, when it only includes the cigarette holder structure A, the vapor temperature may be lowered by 15-18° C.; when it includes both of the cigarette holder structure A and the tobacco formulation B, the vapor temperature may be lowered by 18-22° C., and further the collapse of the filter tip may be effectively prevented.

Embodiment 3

Figure 3:
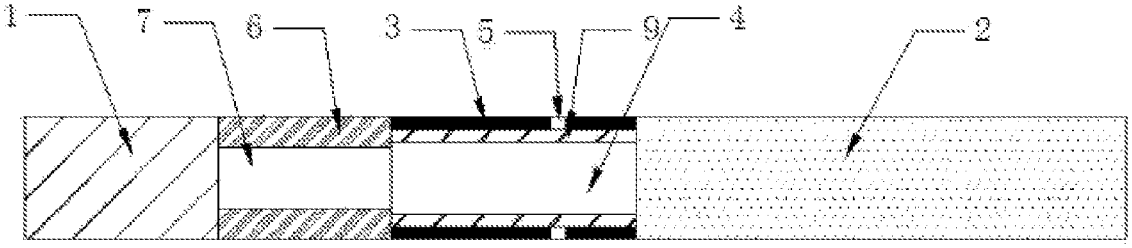
FIG. 3 is a structural representation of Embodiment 3 of the low temperature cigarette having a decreased vapor temperature and preventing the heat-caused collapse of a cigarette holder according to the invention.
Figure 4:
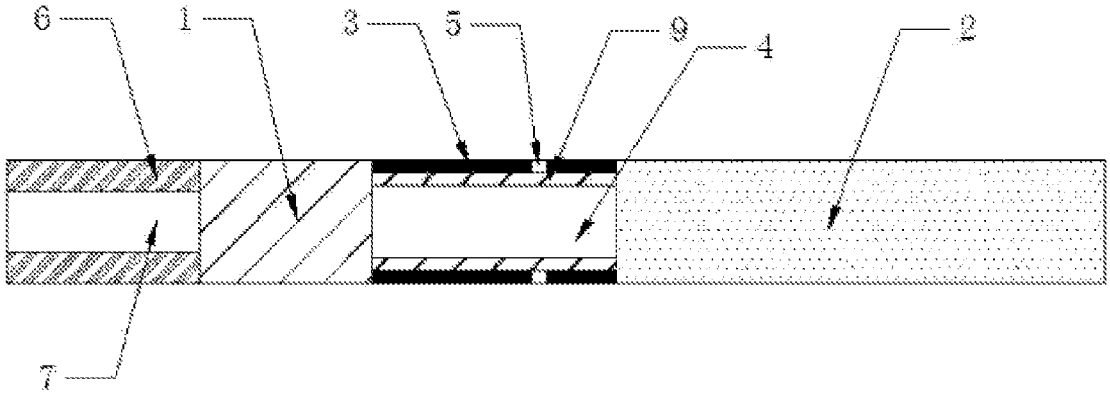
FIG. 4 is a structural representation of Embodiment 4 of the low temperature cigarette having a decreased vapor temperature and preventing the heat-caused collapse of a cigarette holder according to the invention.
Figure 5:
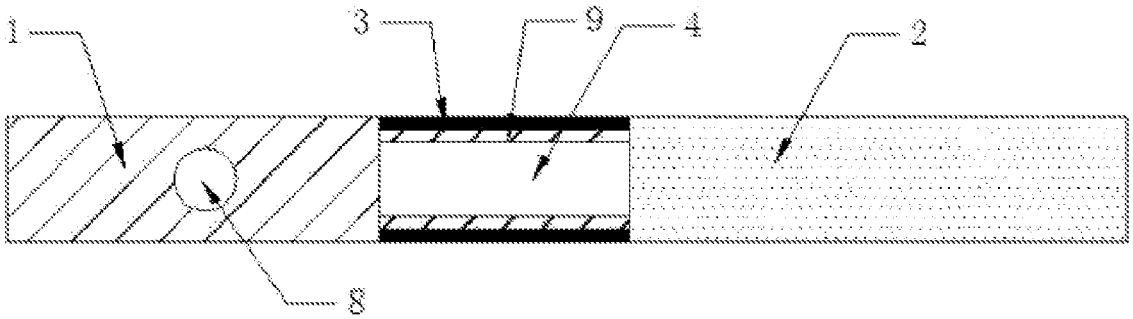
FIG. 5 is a structural representation of Embodiment 5 of the low temperature cigarette having a decreased vapor temperature and preventing the heat-caused collapse of a cigarette holder according to the invention.

FIG. 3 shows a low temperature cigarette having a decreased vapor temperature and preventing the heat-caused collapse of a cigarette holder according to the invention, which includes a filter tip 1, a heat-resistant hollow section and a tobacco section 2 sequentially connected, where the heat-resistant hollow section is constructed by a heat-resistant hollow section housing 3, a heat-absorbing layer 9 and a hollow layer for heat-resistant hollow section 4, and a perforation treatment is performed at a certain position on the heat-resistant hollow section housing 3, thereby forming a vent hole 5. When such a tobacco rod is consumed via peripheral heating, the hot air flow in the heated tobacco section 2 flows into the hollow layer for heat-resistant hollow section 4 along the tobacco rod direction and is mixed with the cold air in the hollow layer for heat-resistant hollow section 4. The outer cold air entering from the vent hole 5 is mixed together with the hot air flow in the tobacco section 2. Further, an inner layer of the heat-resistant hollow section housing 3 is coated with a heat-absorbing layer 9 of a phase-change heat-absorbing material (for example, polylactic acid), and the phase-change material absorbs the heat in the hot air flow via phase change, thereby jointly lowering the vapor temperature.

The difference from Embodiment 2 lies in that: the filter tip 1 is provided with a hollow section near the heat-resistant hollow section, thereby forming a hollow filter tip, which includes a hollow filter tip housing 6 and a solid filter tip hollow layer 7. The hollow filter tip may lower the interception of the vapor from the heat-resistant hollow section, and because the hollow diameter of the hollow filter tip is less than the diameter of the hollow section 4, convection and buffering of the vapor flow may be caused, so that the vapor temperature may be lowered while maintaining the vapor and smoke effect.

Further, the heat of the tobacco rod transferred from the cigarette paper housing in the tobacco section 2 is blocked by the heat-resistant hollow section, thus the heat can be prevented from directly reaching the filter tip 1, so that the heated temperature of the filter tip 1 can be lowered, and heat-caused collapse of the filter tip material and the reduced filtering effect caused by it can be prevented. In this example, the heat-resistant hollow section is constructed by a hollow paper rod, and the wall thickness of the hollow paper rod is 0.8 mm. Such a cigarette holder structure is marked as C.

In this example, the tobacco section 2 contains tobacco shreds, tobacco slices, an atomizing agent, a tobacco extract, tobacco flavors and essences, etc., where, with respect to the total weight of the tobacco section 2, the tobacco shreds occupy 20% of the total weight, the tobacco slices occupy 55% of the total weight, the atomizing agent which consists of glycerol, ethylene glycol and water in a mass ratio of 10:10:1 occupies 19% of the total weight, the tobacco extract occupies 4.9% of the total weight, the tobacco flavors and essences occupy 0.1% of the total weight, and the water-containing heat-sensitive capsule occupies 1% of the total weight. This tobacco formulation is marked as D. During heating of the tobacco section, when the temperature exceeds 220° C., the water and the flavoring in the heat-sensitive capsule can be released, and the volatilization of water lowers the temperature of the tobacco section, so that the temperature of the vapor entering the hollow layer for heat-resistant hollow section 4 is overall lowered, which is convenient for the subsequent cooling.

By the structure of the novel cigarette prepared in this example, the cigarette vapor temperature may be apparently lowered, and in comparison with the prior-art tobacco rod, under the same condition, when it only includes the cigarette holder structure C, the vapor temperature may be lowered by 16-19° C.; when it includes both of the cigarette holder structure C and the tobacco formulation D, the vapor temperature may be lowered by 18-23° C., and at the same time the collapse of the filter tip may be effectively prevented.

Embodiment 4

A low temperature cigarette having a decreased vapor temperature and preventing the heat-caused collapse of a cigarette holder comprises a filter tip 1, a heat-resistant hollow section and a tobacco section 2 sequentially connected, where the heat-resistant hollow section is constructed by a heat-resistant hollow section housing 3, a heat-absorbing layer 9 and a hollow layer for heat-resistant hollow section 4, and a perforation treatment is performed at a certain position on the heat-resistant hollow section housing 3, thereby forming a vent hole 5. Further, an inner layer of the heat-resistant hollow section housing 3 is coated with a heat-absorbing layer 9 of a phase-change heat-absorbing material, where the phase-change material absorbs the heat in the hot air flow via phase change, and the phase-change material is hydroxy acrylic resin. The difference from Embodiment 3 lies in that: the outer end of the filter tip 1, i.e., the end far from the heat-resistant hollow section, is provided with a hollow section, thereby forming a hollow filter tip, which includes a hollow filter tip housing 6 and a solid filter tip hollow layer 7. The hollow filter tip may lower the interception of the vapor from the filter tip 1 and lower the vapor temperature, thereby well maintaining the vapor and smoke effect. This cigarette holder structure is marked as E.

In this example, the tobacco section 2 contains tobacco shreds, tobacco slices, an atomizing agent, a tobacco extract, a non-tobacco extract, tobacco flavors and essences, etc., where, with respect to the total weight of the tobacco section 2, the tobacco shreds occupy 15% of the total weight, the tobacco slices occupy 65% of the total weight, the supplementary material occupies 0.5% of the total weight, the atomizing agent which consists of glycerol and ethylene glycol in a mass ratio of 3:2 occupies 16% of the total weight, the tobacco and non-tobacco extracts occupy 2.5% of the total weight, the tobacco flavors and essences occupy 0.5% of the total weight, and the water-containing heat-sensitive capsule occupies 0.5% of the total weight. This tobacco formulation is marked as F. During heating of the tobacco section, when the temperature exceeds 220° C., the water and the flavoring in the heat-sensitive capsule can be released, and the volatilization of water lowers the temperature of the tobacco section, so that the temperature of the vapor entering the hollow layer for heat-resistant hollow section 4 is overall lowered, which is convenient for the subsequent cooling.

By the novel cigarette prepared in this example, the cigarette vapor temperature may be apparently lowered, and in comparison with the prior-art tobacco rod containing no heat-sensitive capsule, the vapor temperature may be lowered by 19-23° C., and at the same time the collapse caused by the direct contact between the filter tip and the tobacco section may be effectively prevented.

By the structure of the novel cigarette prepared in this example, the cigarette vapor temperature may be apparently lowered, and in comparison with the prior-art tobacco rod, under the same condition, when it only includes the cigarette holder structure E, the vapor temperature may be lowered by 16-18° C.; when it includes both of the cigarette holder structure E and the tobacco formulation F, the vapor temperature may be lowered by 19-21° C., and at the same time the collapse of the filter tip may be effectively prevented.

Embodiment 5

A low temperature cigarette having a decreased vapor temperature and preventing the heat-caused collapse of a cigarette holder comprises a filter tip 1, a heat-resistant hollow section and a tobacco section 2 sequentially connected, where the heat-resistant hollow section is constructed by a heat-resistant hollow section housing 3, a heat-absorbing layer 9 and a hollow layer for heat-resistant hollow section 4. Further, an inner layer of the heat-resistant hollow section housing 3 is coated with a heat-absorbing layer 9 of a phase-change heat-absorbing material, where the phase-change material absorbs the heat in the hot air flow via phase change, and the phase-change material is a mixed material of hydroxy acrylic resin and polylactic acid in a ratio of 1:1. In this example, the heat-resistant hollow section is constructed by a hollow paper rod, and the wall thickness of the hollow paper rod is 0.9 mm. The difference from Embodiment 1 lies in that: the filter tip section 1 is added with a fragile flavoring capsule 8, and before the tobacco section 2 is heated, the fragile flavoring capsule is crumbed, the flavors and essences are released, and the flavors and essences are ushered out by the hot air flow of the tobacco section 2, thus the vapor flavor may be increased, and the vapor taste may be improved. The capsule may be a mint-type capsule, and the mint coolness may lower the feeling of the vapor temperature of the cigarette. Such a cigarette holder structure is marked as G.

In this example, the tobacco section 2 contains tobacco shreds, tobacco slices, an atomizing agent, a tobacco extract, a non-tobacco extract, tobacco flavors and essences, etc., where, with respect to the total weight of the tobacco section 2, the tobacco shreds occupy 20% of the total weight, the tobacco slices occupy 58% of the total weight, the supplementary material occupies 2% of the total weight, the atomizing agent which consists of glycerol, ethylene glycol and ethanol in a mass ratio of 10:10:0.5 occupies 10% of the total weight, the tobacco and non-tobacco extracts occupy 4.5% of the total weight, the flavors and essences occupy 0.5% of the total weight, and the water-containing heat-sensitive capsule occupies 5% of the total weight. This tobacco formulation is marked as H. During heating of the tobacco section, when the temperature exceeds 220° C., the water and the flavoring in the heat-sensitive capsule can be released, and the volatilization of water lowers the temperature of the tobacco section, so that the temperature of the vapor entering the hollow layer for heat-resistant hollow section 4 is overall lowered, which is convenient for the subsequent cooling.

By the structure of the novel cigarette prepared in this example, the cigarette vapor temperature may be apparently lowered, and in comparison with the prior-art tobacco rod containing no heat-sensitive capsule, the vapor temperature may be lowered by 18-22° C., and at the same time the collapse of the filter tip may be effectively prevented, and the vapor taste may be improved.

By the structure of the novel cigarette prepared in this example, the cigarette vapor temperature may be apparently lowered, and in comparison with the prior-art tobacco rod, under the same condition, when it only includes the cigarette holder structure G, the vapor temperature may be lowered by 17-19° C.; when it includes both of the cigarette holder structure G and the tobacco formulation H, the vapor temperature may be lowered by 22-25° C., and at the same time the collapse of the filter tip may be effectively prevented.

In this embodiment, the heat-resistant hollow section housing 3 may also be formed with a vent hole 5 in communication with the hollow layer for heat-resistant hollow section 4.

Preferably, in the above embodiment, a hollow section, which is surrounded by a housing having no heat absorption nature, may also be provided between the heat-resistant hollow section and the tobacco section 2, thus excessively fast and severe shrinkage of the heat-resistant hollow section potentially caused by the direct contact between the heat-resistant hollow section and the heated tobacco may be prevented.

Preferably, in the above embodiment, the outer wall of the filter tip 1 section may also be radially provided with a vent hole, through which outer air may be introduced to assist cooling.

The above description only shows some specific implementation modes of the invention. However, the protection scope of the invention will not be limited thereto, and all variations or substitutions easily made by one skilled in the art will pertain to the protection scope of the invention. Therefore, the protection scope of the invention will be defined by the protection scope of the claims.

What is claimed is:

1. A cigarette capable of lowering a vapor temperature and preventing heat-caused collapse of a cigarette holder, comprising a filter tip and a tobacco section, wherein: the cigarette further comprises a heat-resistant hollow section provided between the filter tip and the tobacco section, the heat-resistant hollow section is constructed by a heat-resistant hollow section housing and a hollow layer for heat-resistant hollow section, and the heat-resistant hollow section is made by rolling a heat-resistant material into a hollow tubular structure, wherein the heat-resistant hollow section housing is formed by the heat-resistant material, the hollow layer for heat-resistant hollow section is a cavity structure surrounded by the heat-resistant hollow section housing, and an inner layer of the heat-resistant hollow section housing is coated with a layer of phase-change heat-absorbing material or the hollow layer for heat-resistant hollow section is filled with a phase-change heat-absorbing material;

wherein: the filter tip section is added with a flavoring capsule that is filled with flavors and essences and is capable of being crumbed;

the tobacco section consists of, by mass percent: tobacco shreds 5%-77%, tobacco sheets 20%-92%, an atomizing agent 2%-40%, supplementary materials 0.1-10%, a tobacco extract 0.1%-20%, tobacco flavors and essences 0.01%-6% and a heat-sensitive capsule 0.1-5%;

the atomizing agent consists of glycerol and ethylene glycol in a mass ratio of (1-4):1;

the heat-sensitive capsule is filled with flavoring water or water, which is released when the heat-sensitive capsule is heated to a temperature higher than 210° C., and the vapor temperature of the cigarette is lowered via the heat absorption by the water or the flavoring water.

2. The cigarette capable of lowering a vapor temperature and preventing the heat-caused collapse of a cigarette holder of claim 1, wherein:

the hollow layer for heat-resistant hollow section has an incompact porous structure or a hollow structure, wherein a ventilation direction of the loose porous structure is consistent with a circulation direction of vapor in the cigarette.

3. The cigarette capable of lowering a vapor temperature and preventing the heat-caused collapse of a cigarette holder of claim 2, wherein:

the hollow structure has a circle, square, rectangle or triangle sectional shape.

4. The cigarette capable of lowering a vapor temperature and preventing the heat-caused collapse of a cigarette holder of claim 3, wherein:

the heat-resistant hollow section housing is formed with a vent hole in communication with the hollow layer for heat-resistant hollow section.

5. The cigarette capable of lowering a vapor temperature and preventing the heat-caused collapse of a cigarette holder of claim 2, wherein:

the heat-resistant hollow section housing is formed with a vent hole in communication with the hollow layer for heat-resistant hollow section.

6. The cigarette capable of lowering a vapor temperature and preventing the heat-caused collapse of a cigarette holder of claim 1, wherein:

the phase-change heat-absorbing material comprises one of a hydroxy acrylic resin and a polylactic acid, or a mixture thereof.

7. The cigarette capable of lowering a vapor temperature and preventing the heat-caused collapse of a cigarette holder of claim 6, wherein:

the heat-resistant hollow section housing is formed with a vent hole in communication with the hollow layer for heat-resistant hollow section.

8. The cigarette capable of lowering a vapor temperature and preventing the heat-caused collapse of a cigarette holder of claim 1, wherein:

the heat-resistant material is selected from a group consisting of a fibrous material, a ceramic material, a non-woven fabric and paper, each of which has a heat-resistant characteristic.

9. The cigarette capable of lowering a vapor temperature and preventing the heat-caused collapse of a cigarette holder of claim 8, wherein:

the heat-resistant hollow section housing is formed with a vent hole in communication with the hollow layer for heat-resistant hollow section.

10. The cigarette capable of lowering a vapor temperature and preventing the heat-caused collapse of a cigarette holder of claim 1, wherein:

the heat-resistant hollow section housing has a wall thickness of 0.5-1.1 mm.

11. The cigarette capable of lowering a vapor temperature and preventing the heat-caused collapse of a cigarette holder of claim 1, wherein: a hollow section is provided between the filter tip and the heat-resistant hollow section, or the hollow section is provided at one side of the filter tip away from the heat-resistant hollow section.

12. The cigarette capable of lowering a vapor temperature and preventing the heat-caused collapse of a cigarette holder of claim 1, wherein:

the heat-resistant hollow section housing is formed with a vent hole in communication with the hollow layer for heat-resistant hollow section.

* * * * *